United States Patent [19]

Sauer

[11] 3,946,347

[45] Mar. 23, 1976

[54] ELECTROMAGNETIC RELAY STRUCTURE

[75] Inventor: Hans Sauer, Deisenhofen, near Munich, Germany

[73] Assignee: Matsushita Electric Works Ltd., Osaka, Japan

[22] Filed: Dec. 28, 1973

[21] Appl. No.: 429,273

[30] Foreign Application Priority Data

Apr. 13, 1973 Germany ..... 2318812

[52] U.S. Cl. ..... 335/202; 335/78; 335/86; 335/125

[51] Int. Cl.[2] ..... H01H 50/04

[58] Field of Search ..... 335/124, 125, 127, 203, 335/202, 128, 131, 133, 106, 82, 81, 80, 79, 78

[56] References Cited

UNITED STATES PATENTS

| | | | |
|---|---|---|---|
| 3,172,975 | 3/1965 | Williams | 335/81 |
| 3,470,506 | 9/1969 | Martin | 335/125 |
| 3,522,564 | 8/1970 | Mori et al. | 335/202 |
| 3,553,729 | 1/1971 | Mori et al. | 335/106 |
| 3,634,793 | 1/1972 | Sauer | 335/78 |
| 3,748,607 | 7/1973 | Mori et al. | 335/86 |

*Primary Examiner*—Harold Broome
*Attorney, Agent, or Firm*—Toren, McGeady and Stanger

[57] ABSTRACT

A structural arrangement is provided for an electromagnetic relay having an armature, coil means, contact means including contact terminals and fixed contacts, and a coil holder body having the armature located therein and being composed of two substantially exactly interfitting and interconnected parts. One part of the coil holder body is formed as a contact holder with the contact terminals and the fixed contacts embedded therein. The other of the two parts of the coil holder body is formed as a cover member configured to at least partly define a contact containing chamber for the relay structure. Alternatively, the two parts of the coil holder body may be formed to essentially consist of two identically constructed contact holders. Additionally, the coil holder body having the armature located therein may be formed in an undivided integral construction with portions adapted to serve as contact holders and containing therein fixed contacts, as well as contact and winding terminals molded to flanges of the integral coil holder.

72 Claims, 38 Drawing Figures

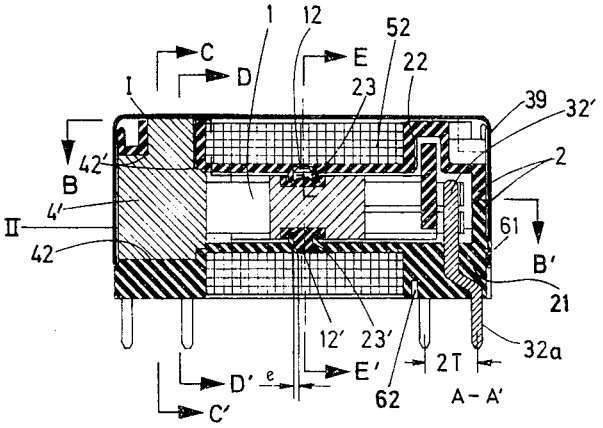
Fig.1
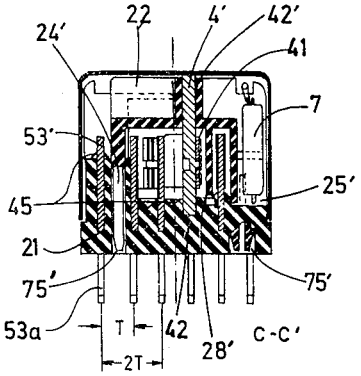
Fig.2
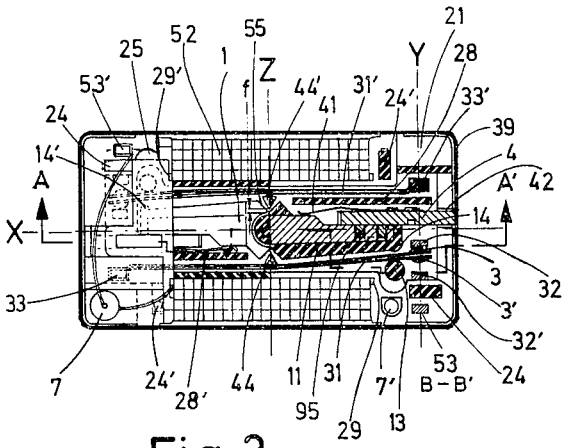
Fig.3
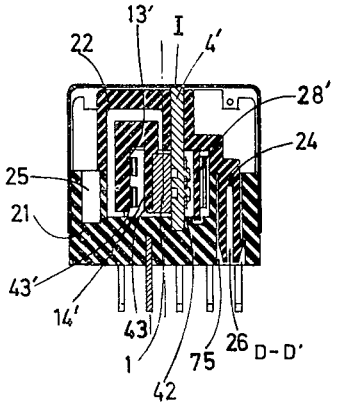
Fig.4
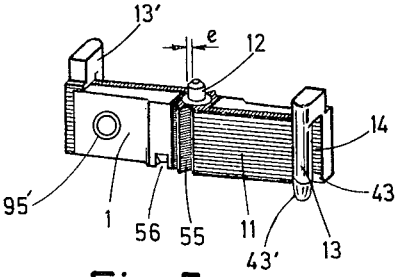
Fig.5
Fig.6
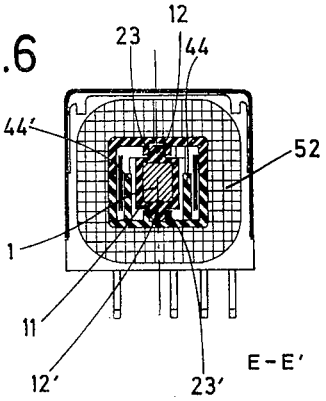

Fig.19
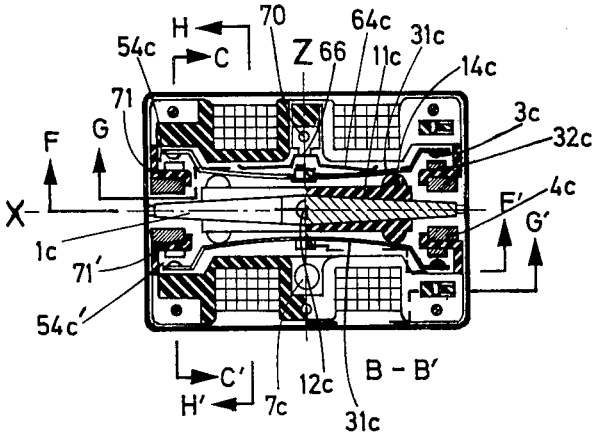
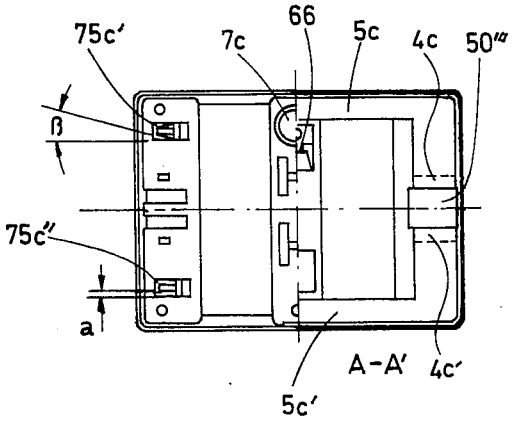
Fig.20
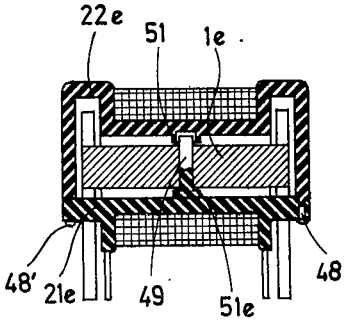
Fig.24

Fig.21
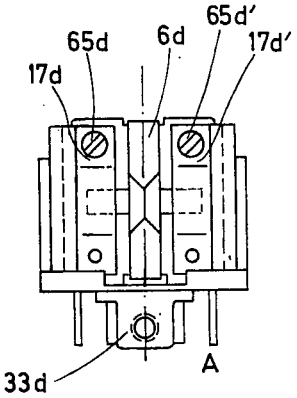
Fig.22
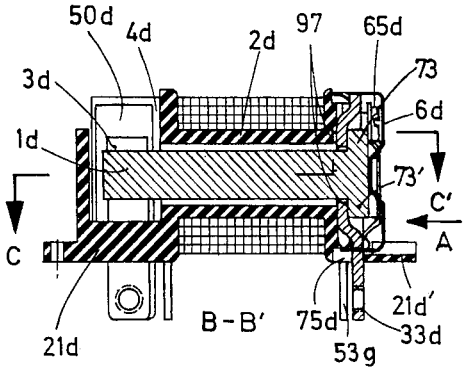
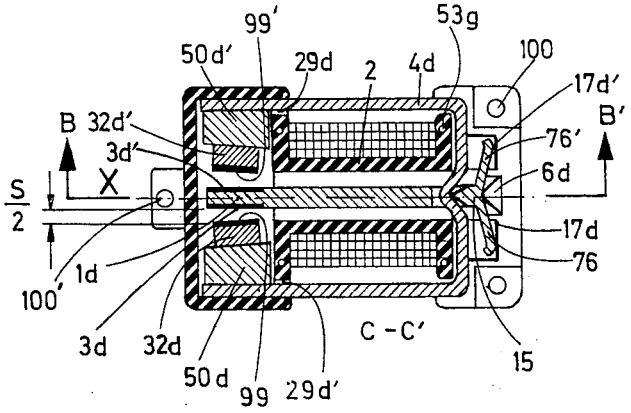
Fig.23

ELECTROMAGNETIC RELAY STRUCTURE

The invention relates to the construction of an electromagnetic relay containing an armature inside the body of a coil holder which consists of two substantially tightly fitting components.

It is known that the armature of an electromagnetic relay may be advantageously located within the coil holder body, thereby obviating the requirement for the otherwise necessary core. Moreover, stray magnetic flux is least in the centre of the coil so that the maximum magnetic flux generated by the energised coil will directly act on the armature. The device of German Patent Specification No. 1,213,917 is aimed at securing these advantages. However, when such relays are built in practice there production cost is fairly high because of the multitude of different operations and/or the large number of different parts which are involved.

It has been proposed in German Patent Specification No. 1,909,940 to accommodate all functional parts of a relay in two matching but different halves of the body of a coil holder, both halves having contacts and terminals and one half in addition being provided with an adjustable contact terminal and associated contact blade. Although this idea has proved practicable it is suitable neither as a multiple contact relay nor for handling heavier currents or voltages. It also has the drawback that the spacing of the contacts is affected by tolerance variation from the design dimensions of the two halves of the coil holder body.

The present invention not only eliminates these defects but also makes available new possibilities for the manufacture and application of such relays. The invention consists in contriving only one of the parts of the coil holder body in such a way that it forms a contact holder in which the contact terminals projecting therefrom to the outside and the fixed contacts are embedded and thus firmly located, whereas the other part at least partly encloses the contact chamber in the form of a cover. In a further development of this idea all functional parts are positively located in relatively fixed positions in the coil holder body and the bearings are also not subject to tolerance variations, a feature which also enables substantial advantages to be secured, even in applications involving an undivided coil holder body. Yet another feature of the invention resides in that the coil holder body is composed of two identical contact holders. The identical nature of the contact holders provides to some extent for the mutual compensation of all tolerance variations of the coil holder halves which affect the contact spacing, and by using sprung contact elements the residual tolerances are rendered substantially ineffective.

The invention will be more particularly described with reference to a number of embodiments shown in the drawings in which:

FIGS. 1 to 6 depict an unpolarised relay containing an armature mounted in its axis of inertia wherein:

FIG. 1 is a section taken on the line A — A′ in FIG. 3,

FIG. 2 is a section taken on the line C — C′ in FIG. 1,

FIG. 3 is a section taken on the line B — B′ in FIG. 1,

FIG. 4 is a section taken on the line D — D′ in FIG. 1,

FIG. 5 is a perspective view of the armature 1 which is partly embedded in a sheath of insulating synthetic plastic material applied by extrusion, injection moulding or press moulding in such a way that armature bearings 12 and guide pins 13 which serve for operating the spring contact blades are integrally formed in the moulding, and FIG. 6 is a section taken on the line E — E′ in FIG. 1.

Figure 7:
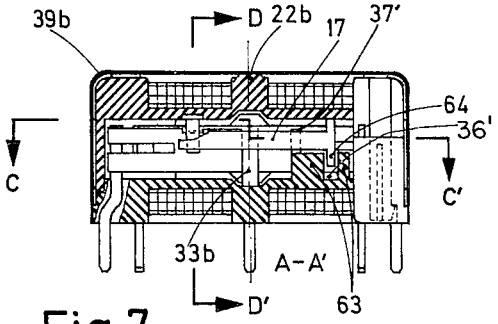
Figure 8:
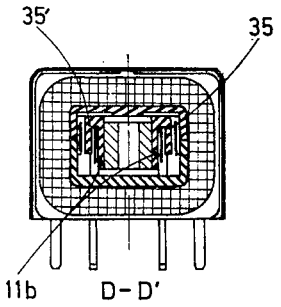
Figure 9:
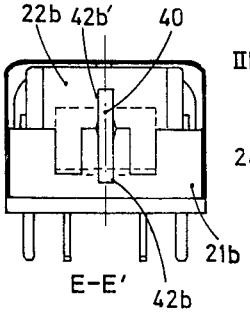
Figure 10:
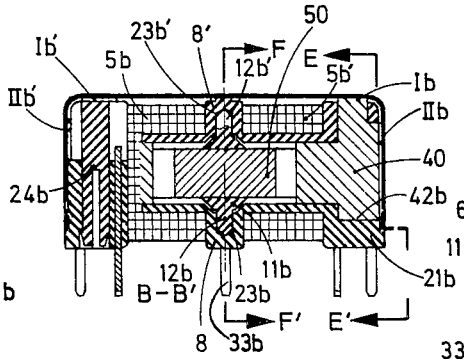
Figure 11:
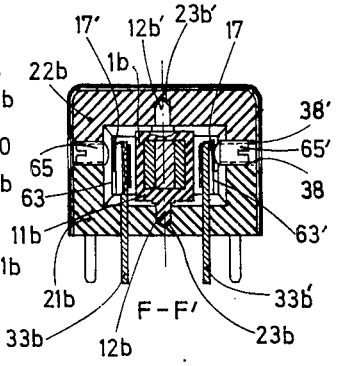
Figure 12:
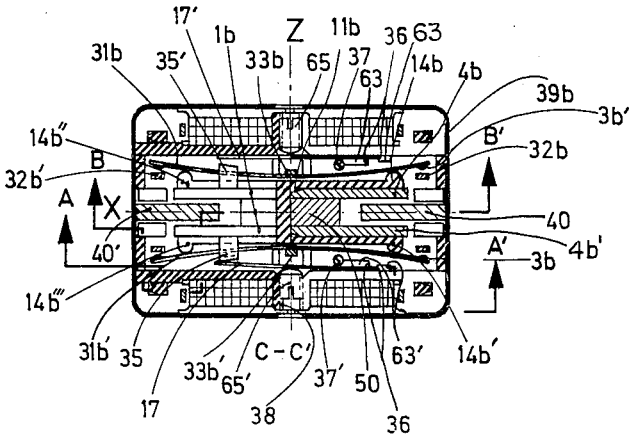

FIGS. 7 to 12 illustrate a polarised relay having a permanent magnet armature 1*b* mounted in its axis of inertia wherein:

FIG. 7 is a section taken on the line A — A′ in FIG. 12,

FIG. 8 is a section taken on the line D — D′ in FIG. 7,

FIG. 9 is a section taken on the line E — E′ in FIG. 10,

FIG. 10 is a section taken on the line B — B′ in FIG. 12,

FIG. 11 is a section taken on the line F — F′ in FIG. 10, and

FIG. 12 is a section taken on the line C — C′ in FIG. 7.

Figure 15:
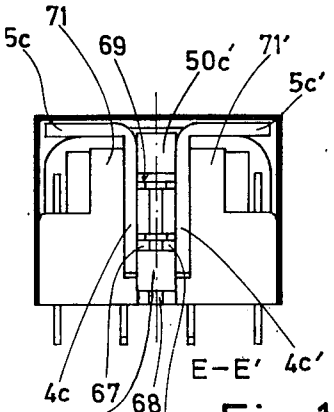
Figure 18:
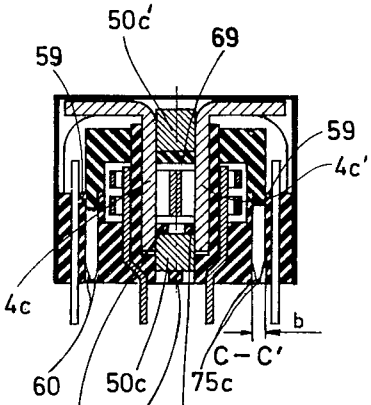
Figure 14:
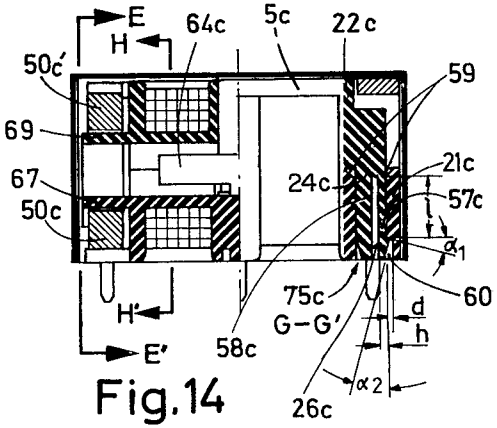
Figure 17:
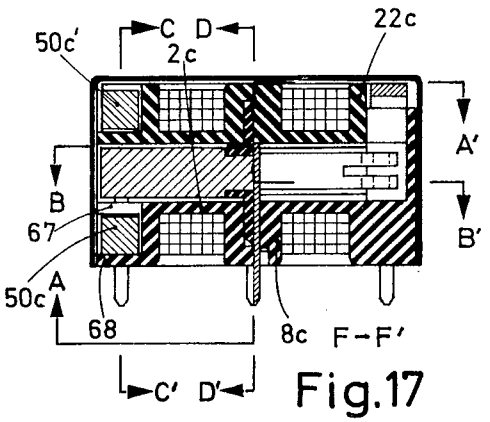
Figure 13:
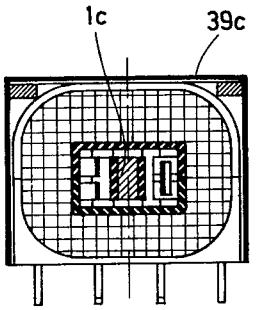
Figure 16:
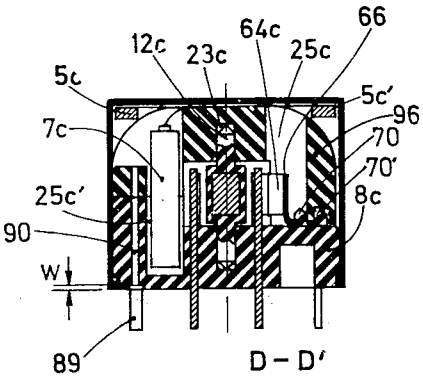

FIGS. 13 to 20 illustrate the application of the invention to a polarised relay containing a soft iron armature 1*c* mounted in its axis of inertia, and a fixed permanent magnet 50*c*, 50*c*′, wherein:

FIG. 13 is a section taken on the line H — H′ in FIG. 14,

FIG. 14 is a section taken on the line G — G′ in FIG. 19,

FIG. 15 is a section taken on the line E — E′ in FIG. 14,

FIG. 16 is a section taken on the line D — D′ in FIG. 17,

FIG. 17 is a section taken on the line F — F′ in FIG. 19,

FIG. 18 is a section taken on the line C — C′ in FIG. 17 and FIG. 19, FIG. 19 is a section taken on the line B — B′ in FIG. 17, and FIG. 20 is a section taken on the line A — A′ in FIG. 17.

FIGS. 21, 22 and 23 illustrate the further application of the invention to a polarised relay having only one change-over contact and an armature 1*d* which conducts the electric current wherein:

FIG. 21 is a diagrammatic view in the direction A of FIG. 22,

FIG. 22 is a section taken on the line B — B′ in FIG. 23, and

FIG. 23 is a section taken on the line C — C′ in FIG. 22.

FIG. 24 is a longitudinal section of a relay in which the contact holder 21*e* is formed with a pivot pin 49, bearing shoulders 51, 51*e* being also formed on the contact holder 21*e* and on the cover 22*e* for locating the armature 1*e* in the vertical direction. Since in this case the bearing bore traverses a soft iron armature 1*e* it is desirable in some applications not to make the pivot pin 49 of a synthetic plastics material but rather of a bearing metal, the metal pin being then secured by conventional methods or by pressing or riveting. FIG. 24 also shows a rigid connection between the cover 22*e* and the contact holder 21*e* by rivets 48, 48′ at two or more points.

Figure 25:
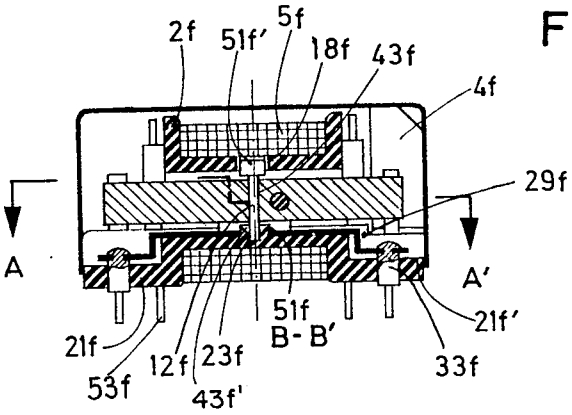
Figure 26:
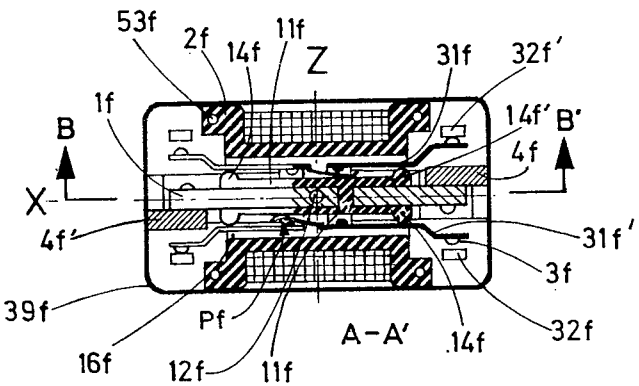

FIGS. 25 and 26 illustrate a further embodiment of the invention in the case of an unpolarised relay in which the body 2*f* of the coil holder is of undivided integral construction and forms a contact holding base.

FIG. 25 is a section taken on the line B — B′ in FIG. 26, and

FIG. 26 is a section taken on the line A — A′ in FIG. 25.

Figure 27:
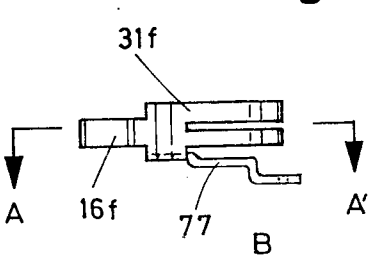
Figure 28:
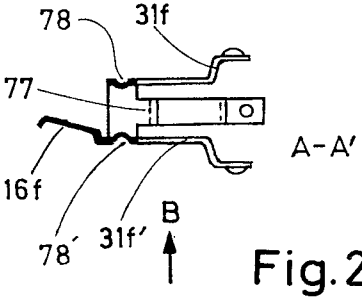

FIGS. 27 and 28 show the spring contact blade 31*f* used in this embodiment.

FIGS. 29 to 32 and 33 to 38 are further developments of the invention exemplified for two polarised relays each comprising two identical halves of a body which serves as a contact holder.

Figure 31:
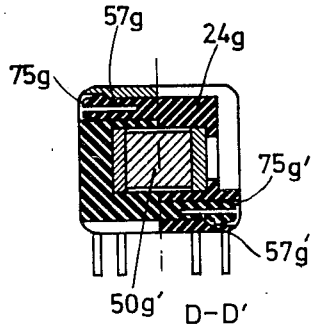
Figure 30:
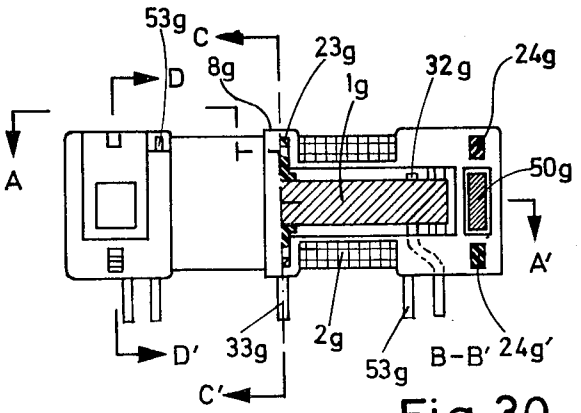
Figure 32:
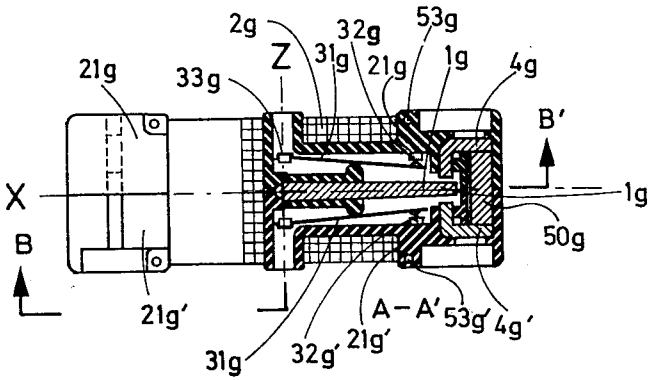
Figure 29:
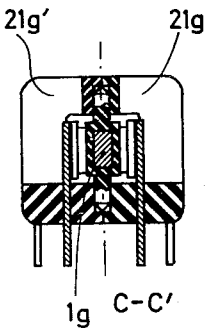
Figure 35:
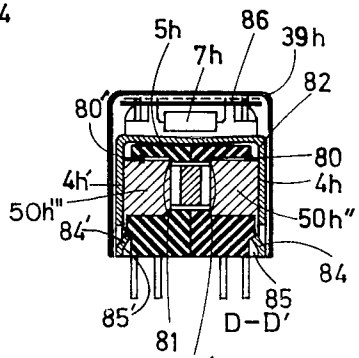
Figure 34:
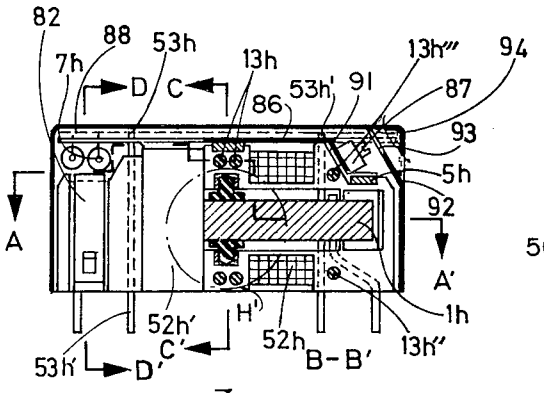
Figure 33:
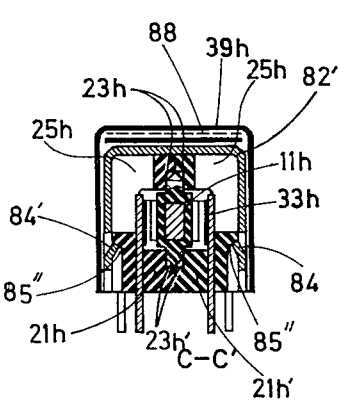
Figure 36:
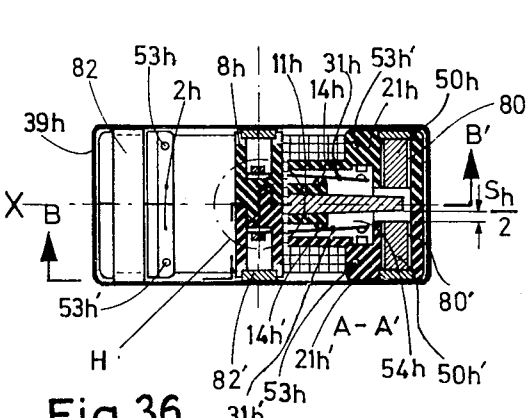

FIG. 29 is a section taken on the line C — C′ in FIG. 30,

FIG. 30 is a section taken on the line B — B′ in FIG. 32,

FIG. 31 is a section taken on the line D — D′ in FIG. 30,

FIG. 32 is a section taken on the line A — A′ in FIG. 30,

FIG. 33 is a section taken on the line C — C′ in FIG. 34,

FIG. 34 is a section taken on the line B — B′ in FIG. 36,

FIG. 35 is a section taken on the line D — D′ in FIG. 34, and

FIG. 36 is a section taken on the line A — A′ in FIG. 34.

Figure 37:
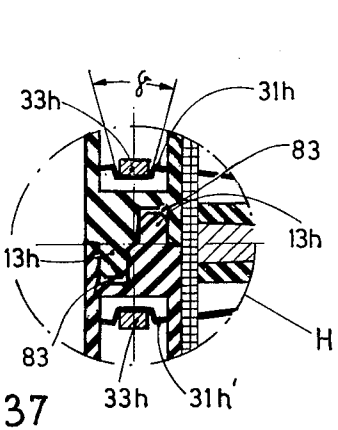
Figure 38:
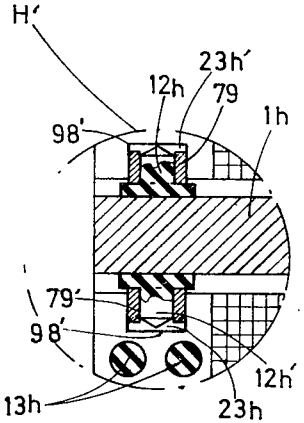

FIGS. 37 and 38 illustrate details, H—H.

The relay illustrated in FIGS. 1 to 6 is diametrically symmetrical about its centre lines X and Z and in many instances particular reference numbers are shown only once for convenience. According to the invention, the coil holder 2 of the relay comprises a bottom member forming a contact holder 21 and an upper member forming a cover 22. Bearings 23, 23′ or sockets for the armature, for instance as described in German Patent Specification No. 1,010,640, are moulded into each part of the coil holder body.

The armature 1 is partly contained inside an injection moulded or extruded synthetic plastics sheath 11 which is integrally formed with pivot pins 12, 12′ as well as with guide pins 13, 13′ for cooperation with spring contact blades 31, 31′ and actuating bosses 14, 14′ having inclined flanks 43, 43′ to facilitate assembly. The tolerance limits are very close because the features which are of importance to the relay, namely the positions of the bearings and of the actuating means, are positively fixed in the production tool, and the production costs are low because all these functional elements as well as a V-shaped slot 55 provided for assembly are produced in one operation without waste of material. Finally, the partial sheath 11 also provides electrical insulation in relation to the spring contact blades 31, 31′. Likewise dimensionally fixed in relation to the bearings 23, 23′ is a recess 42 in the contact holder 21 and a recess 42′ in the cover 22 for the firm reception therein of poleshoes 4, 4′. An armature restoring spring 41 is riveted to each poleshoe 4, 4′ preferably with the aid of pronounced round-headed rivets. The necessary bias is imparted to the armature restoring spring 41 by a V-shaped notch 56 when the armature is inserted into the bearing 23′. The contact holder 21 which constitutes the lower portion of the coil holder consists of a dimensionally stable synthetic plastics material. Fixed contacts 32, 32′ as well as contact terminals 33 and 33′ and coil terminals 53, 53′ are embedded by an extruding, injection or press moulding operation. In a further development of the invention the fixed contacts 32, 32′ as well as the contact and winding terminals 32*a*, 33, 33′, 53, 53′, 53*a* are of similar shape so that their external pins 32*a*, 53*a* are spaced at so-called 'fives' pitched standard intervals 2T for conductor plates, whereas in the interior facing of the cover 22 they are located in a bank Y at intervals T known as a 2.5 pitch.

The fixed contacts 32, 32′ contain a metal faceplate, such as Ag, AuNi, AgPd or the like on the side facing the movable contacts 3, 3′. Moreover, the terminal pins preferably consist of German silver for the sake of easy soldering or spot welding.

The spring blades 31, 31′ are connected to the inside terminals 33, 33′ preferably by spot welding or brazing. These spring blades are folded back upon themselves and splayed at their ends in such a way that during deflection they bear against the guide pin 13 or the actuating boss 14 with a predetermined amount of spring pressure. When the relay is energised, as in the drawing, the actuating boss 14 lifts off the spring blade 31 and a predetermined spring pressure is applied by contact 3 to the fixed contact 32. When the relay is not energised, the armature 1 is urged by the biased restoring spring 41 into its position of rest which is not shown in the drawing. The contact 3 is thus withdrawn from contact 32 by the actuating boss 14, and the guide pin 13 lifts off the spring contact blade 31 as soon as the contact 3′ strikes the fixed contact 32′, contact pressure being again provided by the bias of the spring blade 31.

For supporting the spring blades 31, 31′ and to permit the armature 1 to be conveniently introduced into the bearing sockets 23′ V-shaped ribs 44, 44′ are so moulded on the contact holder 21 that the distance *f* between the vertix of a V-shaped rib 44′ and the V-shaped slot 55 is less than the amount *e* whereby the pivot pin 12′ tapers in relation to its bearing socket 23′.

In the cover 22, which forms the upper part of the coil holder, and which consists of an insulating synthetic plastics material, locating studs 24, 24′ are moulded on the cover for cooperation with corresponding recesses 75, 75′ in the contact holder 21. The two parts (21, 22) are thus fixed together and connected. A particularly economical connection is achieved by providing the locating studs 24, 24′ with slots 26 which impart spring to the split ends of the studs. A similar connection is shown in FIGS. 14, 18, 19 and 20.

A split 26*c* in FIG. 14 divides a locating stud 24*c* into a sprung end 57*c* and a stiff end 58*c* and is slightly shorter than the depth of penetration of the locating stud 24*c* into the contact holder 21*c* in order to prevent the tightness of fit of the contact holder 21*c* in the cover 22*c* from being impaired by the sprung ends of the locating pin 57*c* yielding and the resin from flowing through the slit 26*c* into the interior of the relay when the latter is being sealed with castable resin.

In order to facilitate fitting the cover 22*c* to the contact holder 21*c* the upper end of the recess 75*c* is provided with a chamfer 59 and/or further chamfering 60 having an angle $\alpha_2$ is provided on the end of the locating stud 57*c*, 58*c*. In order to prevent the sprung end 57*c* of the locating stud from being impaired in its function by friction with the wall of the recess 75*c* and 75*c′* this is either formed with sloping flanks $\beta$ (FIG. 20) or arranged to have clearance *a* in relation to the wall of the recess 75*c*′ and 75*c* ″ (FIG. 20). The sprung end 57*c* of the locating stud is provided with a projection *d* (FIG. 14) which snaps into an enlargement in the recess 75*c*. In order to compensate any tolerances which might impair a tight fit between the cover 22*c* and the contact holder 21*c* the projection *d* has a bevel of angle $\alpha_1$ at the point of engagement. If this angle is say 15° and the projection $d = 0.6$ mm, a tolerance of $d \times \tan \alpha_1 = 0.16$ can be compensated. The forces which arise are similarly satisfactory.

In the case of a spring deflection *f* of 0.8 mm provided by appropriate shaping, for instance by chamfering the sprung end of the locating stud, a sprung length *l* of 8 mm, a thickness $h = 1$ mm, a width $b = 1$ mm and a Young's moldulus of 850 kg/sq.mm, the spring force is $P_s = f \cdot E \cdot b \cdot h^3 / 4 \cdot l^3 = 0.33$ kg. Assuming that $\alpha_1 = \alpha_2 = 15°$ and a coefficient of friction $\mu = 0.1$ for the synthetic plastics materials which are here practicable (e.g. "Delrin", diallyl phthalate, "Crastine"), then the force needed for the insertion of four such locating studs would be $P_M = 4 \cdot P_s (\sin \alpha_2 + \alpha \cos \alpha_2) = 0.47$ kg. The cover 22*c* pulls itself into the contact holder 21*c* with a force $P_H \sim 4P_s \cdot (\cot \alpha_1 - \mu) \sim 4.8$ kg, i.e. about 4000 times its own weight.

This example shows that the application of little effort in manual assembly without the use of tools permits a sufficiently stable connection to be achieved and that the forces involved can be varied very considerably by slight variations of the angles $\alpha_1$, $\alpha_2$ and/or of the thickness *h* or the length *l*, bearing in mind that the forces vary with the third power of these parameters.

Demands for very small relays possessing high breakdown and insulation resistance can thus be met by providing the cover 22 with partitions 28, 28′ (FIGS. 2, 3, 4) and the contact holder 21 with notches 45 or recesses 62. The partition 28 is therefore not yet present when the spring contact 31 is fitted and is not in the way. Another requirement which miniature relays of relatively high current breaking performance are often required to satisfy is ability to handle alternating current. A.c.-energised relays usually contain a short-circuiting ring at the pole face of the core. However, since relays according to the present invention lack a core, a short circuiting ring 95 and/or 95′, consisting for instance of copper, is pressed into suitable recesses either in the armature 1 facing the polesholes 4, 4′ or into a suitable location in the pole-shoes 4 and/or 4′. However, since high resistance of the windings is needed for operation with a mains voltage of 220 volts, calling for very thin wires in the case of miniature relays containing little winding space, the coil holder 2 contains recesses 25, 25′ in which components (such as resistors, capacitors or diodes) for smoothing the a.c. or for attenuating the energising current are accommodated. In order to provide a relay which is specially suitable for a.c. excitation the said smoothing devices may be used alone or in combination with one or two short circuiting rings 95, 95′. The flanges of the cover 22 and/or contact holder 21 contain slots 29, 29′ for the ends of the windings so that they cannot be electrically or mechanically influenced by neighbouring turns of the winding.

Another advantage of this invention is that the windings 52, which must naturally be different for every voltage, can be fitted to the relay after it has been mounted. Consequently more generous plans can be laid for large scale production without incurring the risk of no outlet being found for lengthy periods for relays having particular windings.

When the coil holder has been wound and connected the relay need merely be closed by fitting a cap 39 which in conventional manner engages a nib 61 on the contact holder 21. The cap 30 consists of ferromagnetic material and in view of the proposed disposition of the poleshoes 4, 4′ of which two faces I, II make contact with the cap it forms a very effective return path for the magnetic flux. The proposed polarised relays in FIGS. 7 to 12, 13 to 20, 21 to 23, 29 to 32 and 33 to 36 are illustrated with their armature 1*b*,1*c*, 1*d*, 1*g*, 1*h* in central position. They are likewise symmetrically constructed with reference to the centre lines X, Z with the exception of one adjusting facility 17, 35 (FIG. 12) which is asymmetrical with respect to the Z-axis. The polarised relay according to FIGS. 7 to 12 contains an H-section armature 1*b* which is symmetrically composed of a permanent magnet 50 and two adjacent poleshoes 4*b*, 4*b*′. According to the invention this three-part armature 1*b* is held together in its inertial axis Z by an embracing plastics sheath 11*b* which is also formed with pivot pins 12*b*, 12*b*′. The plastics sheath 11*b* continues over the two outer faces 1*f* of the poleshoes 4*b*, 4*b*′, and actuating bosses 14*b*, 14*b*′ are formed on the outer ends as well as angle pieces 35, 35′ between the inertial axis Z and the actuating bosses 14*b*″, 14*b*‴, the angle pieces partly embracing the spring contact blades 31*b*, 31*b*′ without touching them and serving as stops for the free ends of adjusting leaf springs 17, 17′.

The contact holder 21*b* which forms the bottom part of the coil holder differs from the contact holder 21 (FIG. 1) principally by the presence of half of a flange 8 in the middle which is formed with the bearing 23*b* as well as with one half shell of an internal thread 38.

For locating the adjusting spring blades 17, 17′ there are provided, on the sides of the core member of the contact holder 21*b* which forms part of the coil body, shoulders 63, 63′ having walls 36, 36′ which are kept free to provide horizontal abutments, and which contain the nose 64 of the adjusting spring blade 17, 17′. Round pips 37, 37′ are also provided to form a fixed rest when the adjusting spring blades 17, 17′ are flexed by the adjusting screws 65, 65′.

Similarly, the cover 22*b* which forms the upper part of the coil holder body differs from the cover 22 (in FIG. 1) principally by the presence of a flange half 8′ in the middle which besides a bearing socket 23*b*′ also contains one half of an internal screw thread 38′ which matches the thread 38 of the other half to form a complete and continuing thread when assembled. Preferably the threads of the two halves 38, 38′ may be slightly staggered, since this constitutes an easy method of ensuring a firm frictional fit of the adjusting screws 65, 65′ in the thread.

The inside contact terminals 33*b*, 33*b*′ are centrally spot welded or brazed to the spring contact blades 31*b*, 31*b*′. The pressure with which the contact 3*b*, 3*b*′ bears against a fixed cooperating contact 32*b*, 32*b* depends not only upon the geometry and spring properties of the spring blade 31*b*, 31*b*′ but also upon the bias which results from the height of the contact 3*b*,3*b*′ and the thickness of the fixed counter-contact 32*b*, 32*b*′, bearing in mind that the fixed contacts 32*b*, 32*b*′ and the contact terminal 33*b*, 33*b*′ are coplanar.

The assembly of the relay illustrated in FIGS. 7 to 12 comprises the following steps:

a. Spot weld or braze spring contact blades 31*b*, 31*b'* to the inner end of the terminals 33*b*, 33*b'*.

b. Introduce adjusting leaf springs 17, 17' into the contact holder 21*b* in such a way that the nose 64 comes to lie between the walls 36' of the shoulder 63.

c. When inserting the armature 1*b* into the bearing sockets 23*b* the spring blades 31*b*, 31*b'* are flexed as already explained in the previous embodiment. Any additional bias of the spring blades 31*b*, 31*b'* that may be required and the simultaneous adjustment of the contact spacing is effected by bevel edges of the actuating bosses 14*b*, 14*b'*, 14*b''*, 14*b'''*, such as a bevel 43' being shown for instance in FIG. 5.

d. Insert counter-poleshoes 40, 40' into fixed recesses 42*b* in the contact holder 21*b*.

e. Insert cover 22*b* into contact holder 21*b* causing four locating studs 24*b* on the cover 22*b* to engage the contact holder 21*b* with tension, as has already been described with reference to the relay illustrated in FIGS. 1 to 6 and with reference to FIGS. 14, 18, 19 and 20. This automatically causes the upper pivot pin 12*b'* of the armature 1*b* to enter the socket 23*b'* whereas the counter-poleshoes 40, 40' enter the fixed recesses 42*b'* in the cover 22*b* and thus assume their exactly prescribed positions.

f. Wind and connect up the coils 5*b*, 5*b'* which are insulatedly separated by the central flange of the coil holder.

g. Affix the cap 39*b* of ferromagnetic material, which then comes into contact with the faces I*b*, II*b*, I*b'*, II*b'* of the counter-poleshoes 40, 40'.

h. Adjust relay for one-sided or two-sided position of rest of the armature and/or for threshold of response by adjusting screws 65, 65'.

In FIG. 12 the adjusting screw 65' is shown in adjusted position. It causes the free end of the adjusting spring blade 17 to bear against the angle piece 35 and thus to determine the forces needed for moving the armature, and hence the response and/or release thresholds of the relay. Finally the relay may be evacuated, filled with a protective gas atmosphere and made airtight by embedment in a castable resin. However, the openings in the cap 39*b* for the adjusting screws 65, 65' must also be covered to ensure that a smooth seal is created and the adjusting screws 65, 65' are locked.

The polarised relay according to FIGS. 13 to 20 is an embodiment of the invention containing a soft iron armature 1*c* and fixed magnets 50*c*, 50*c'*. The partial armature sheath 11*c*, the bearings 12*c*, 23 and the shape of the coil holder 2*c* are substantially similar to those described with reference to the preceding examples. For vertically locating the permanent magnets 50*c*, 50*c'* and for the simultaneous location of the poleshoes 4*c*, 4*c'*, the contact holder 21*c* is formed with ribs 67, 67'. These ribs 67, 67' are so contrived that clearance remains between them, permitting a rib 68 in a different plane which likewise vertically locates the permanent magnet 50*c* to be formed in one and the same operation. The cover 22*c* contains a corresponding complete rib 69 since upward and lateral location is provided by the plastics cap 39*c*.

The central flange 8*c* on the contact holder 21*c* is formed with locating pins 70, 70' for locating an adjusting spring 64*c*, the pins engaging cooperating holes in the adjusting spring 64*c*. When assembled the end of the adjusting spring 64*c* located by the locating pins 70, 70' (FIG. 16) is urged against the contact holder 21*c* by an appropriate boss 96 formed inside the cover 22*c*. The adjusting spring 64*c* is thus positioned. If the locating pins 70, 70' consist of a thermoplastic material they may just as readily be used for hot welding the root of the adjusting spring 66 to the contact holder 21*c*. A conventional riveted joint would also be feasible. The relay is adjusted by radial flexure of the root end 66 of the two-bladed adjusting spring 64*c* of a fork-like tool.

In the embodiment shown in FIG. 19 the adjusting spring 64*c* has been set so that one of its spring ends bears on the biased spring contact blade 31*c* which bears on the actuating boss 14*c*. This has the advantage that the thrust of the adjusting spring 64*c* provides a supplementary force transmitted by the spring blade 31*c* to the contact pair 3*c*/32*c* as soon as the actuating boss 14*c* is withdrawn from the spring blade 31*c*. In this state the armature 1*c* will have left its centre position and, since in such permanent magnet systems, as described for instance in U.S. Pat. No. 1,255,133, any effect of the adjusting spring 64*c* continuing substantially beyond the centre position of the armature 1*c* is always undesirable, the proposed arrangement ensures not only improved contacting reliability, but also a simple method of adjustment, particularly when a second adjusting spring of the same kind is available on the mirror symmetrically opposite side so that the operate response and the release response of the relay can be cleanly preset completely independently the one from the other.

A major advantage which the proposed form of construction of the relay also offers is that according to the desired sensitivity of response and/or insensitivity to vibrations one, two, three or four permanent magnets 50*c*, all of like dimensions and shape, can be inserted into pockets provided in the coil holder 2*c* without necessitating modifications in design.

Similarly magnets having different properties can be used in combination.

For instance, assuming that two or three barium ferrite magnets are combined with correspondingly two or one AlNiCo magnets, which are well known to have widely different temperature coefficients, then the conditions for a good compensation of the effect of ambient temperature on the response voltage of the relay are good, particularly in conjunction with the above-described effects of the contact spring 31*c* and adjusting spring 64*c*. The two poleshoes 4*c*, 4*c'* are off-angled from the yoke 5*c*, 5*c'* and located between the rib 69 on the cover 22*c* and on the one hand the ribs 67, 67' of the contact holder 21*c* and on the other hand the webs 71, 71' which form the contact chamber 54*c*, 54*c'* and which are parts of the contact holder. If a second adjusting spring 64*c* is provided, then the large recess 25*c'* which is intended in the contact holder for other components, must be dispensed with to enable this second adjusting spring together with the locating pins 70, 70' to be located in a mirror symmetrical position to the spring on the opposite side. After adjustment has been made the remaining space in the recess 25*c* may also be used for accommodating the previously mentioned components. In a relay with symmetrically positioned terminals it is advisable to make arrangements to prevent mistakes in assembly. For this reason the contact holder 21*c* is provided, according to the invention, with a locating pin 89 having a relatively thin wall, above which is a locating hole 90. If an additional terminal pin, either for earthing the relay or as a terminal for components 7*c* inside the relay or for other integrated circuit arrangements, is needed, then this locating pin 89 can be broken off to make the locating hole 90 available for the insertion thereinto of an additional terminal pin which may be located by a tight friction fit or by pinching together the contact holder 21*c* and/or the cover 22*e*.

The polarised relay in FIGS. 21, 22, 23 is another development of the invention in which the coil holder 2*d* is an undivided single component and is merely formed at its flanges with contact holder elements 21*d*, 21*d'* for fixed contacts 31*d*, 31*d'*. A slightly extended flange on the coil holder 2*d* contains slots 29*d*, 29*d'*, whereas a recess 75*d* is provided in the contact holder member 21*d'* for the reception of the two limbs of the U-shaped yoke 4*d* or of a third limb perpendicularly branching from the yoke 4*d* for the purpose of forming a centre contact terminal 33*d*.

This relay is designed for rupturing heavier loads and its armature deflection is therefore fairly large, the contact forces are high and the conductor cross sections considerable. Nevertheless, this relay is also intended to be inexpensive to make and to function reliably. These requirements are satisfied for the following reasons:

a. The fixed contacts 31*d*, 31*d'* consist of ferromagnetic material and merely have a faceplate 99 made of contact material simultaneously serving as a magnetic separator. Also, the armature 1*d* of ferromagnetic material is likewise provided at points facing the fixed contacts 31*d*, 31*d'* with faceplates 3*d*, 3*d'* also serving as magnetic separators.

b. The fixed contacts 31*d*, 31*d'* are inclined towards the centre axis X in such a way that when the faces of the contacts 3*d*, 3*d'* close with the faces of the fixed contacts 31*d*, 31*d'* they will both be coplanar. This means that burn-off will be distributed over a relatively wide contact face. The fact which may at first sight be thought a drawback that the thickness of the separators becomes thinner as burn-off progresses actually has the inherent advantage that with continuing burn-off which raises the contact resistance, the contact-making forces rise in accordance with the decreasing width of the air gap and thus counteract the increase in contact resistance due to burn-off.

c. According to the angularity of the fixed counter-contacts 31*d*, 31*d'* which also form poleshoes, the abutting surfaces of the permanent magnets 50*d*, 50*d'* which consist of electrically insulating barium ferrite are chamfered. This has the advantage that the permanent magnets 50*d*, 50*d'* can be easily inserted between the stationary fixed contacts 31*d*, 31*d'* forming the pole-shoes and the two ends of the U-shaped yoke 4*d* and then keyed in together with the permanent magnets, so that tolerational differences compensate and a good magnetic flux transfer is assured.

d. The soft iron armature 1*d* is T-shaped, the cross members 73, 73' of the Tee being formed with a knife edge 15 and with two wings 76, 76' in one operation. The knife edge 15 rests in a Vee-notch formed in the yoke 4*d* and is urged into the notch by an armature-retaining spring 6*d* having ends engaging angles in the bottom of the yoke 4*d*.

e. One end of each two adjusting springs 17*d*, 17*d'* is anchored, preferably by riveting, to the bottom of the yoke 4*d* whereas the other ends are flexed by adjusting springs 65*d*, 65*d'* in such a way that the armature wings 76 and 76' underneath are selectably sufficiently loaded to keep the armature 1*d* in stable position on one or both sides to operate or to release at the desired response levels.

The problem which arises when a relatively high current is to be carried from the current conducting armature through the yoke to the contact terminal 33*d* is solved by providing as many points of contact between the electrically conducting armature and the yoke carrying the current to the contact terminal 33*d*.

In the illustrated example these are the two knife edges 15 on the T-member 73, 73' which is pressed with considerable force into the Vee notch in the yoke 4*d*, the contact point of the armature-retaining spring 6*d*, and the contact points between the adjusting springs 17*d*, 17*d'* and the armature wings 76, 76'.

Finally it should be mentioned that the armature 1*d* is located with relatively little clearance in an opening 97 which is in the plane of the yoke 4*d*.

FIGS. 25 and 26 illustrate an unpolarised relay of symmetrical design in the energised position. The invention is here applied to an integral undivided coil holder containing an armature 1*f* mounted in the inertial axes X and Z. The armature 1*f* is provided with a partial sheath 11*f* which at its ends is formed with actuating bosses 14*f*, 14*f'* and it has a bore with a funnel-shaped opening 43*f*.

As in the preceding embodiments contact holding elements 21*f*, 21*f'* are formed on the two flanges of the integral coil holder body 2*f*. A contact blade 31*f*, 31*f'* is shown in side view in FIG. 27 and in a section taken on the line A — A in FIG. 28. The spring is formed with a lateral locating web 77 which cooperates with a locating slot 29*f* centrally formed in the coil holder body 2*f*. The contact blades proper 31*f*, 31*f'* project from each side of the locating web 77, the off-angled blades being strengthened by the provision of flutings 78, 78'. This geometry permits the armature 1*f* to be inserted into the coil holder body 2*f*, without being obstructed, after the locating web 77 has first been electrically and mechanically firmly connected to the terminal 33*f* which is embedded in a fixed position in the contact holding element. A spring member which serves as an armature restoring spring 16*f* extends at an angle of about 10° from one flank provided with an indentation 78' in a direction opposite to that of the contact spring and, when assembled, one end of this spring member bears against the insulating partial sheath 11*f* enclosing the armature 1*f*, applying a thrust $P_f$ (FIG. 26) which in the non-energised state of the relay (not shown) maintains contact between 3*f* and 32*f* by the action of the boss 14*f* formed on the partial sheath 11*f* of the armature 1*f*, bearing in mind that the point of application of the force $P_f$ is on the opposite side of the pivot bearing (12*f*, 23*f*) of the armature 1*f* constituting the rest contact force.

The socket opening 18*f* in the centre of the coil holder 2*f* which serves as a pivot bearing, and which is formed with a funnel-shaped entry 43*f'* to facilitate insertion of the pivot pin 12*f* and the shoulder 51*f* which keeps the armature 2*f* in a vertical position are moulded in one operation in the upper part of the injection or pressure mould producing the coil holder body 2*f*. Preferably, the bearing 23*f* is a pressed-in cup for the reception of the pivot pin 12*f* to permit an insulation of the shoulder 51*f'* from the coil windings 5*f* to be dispensed with and clearance maintained.

The poleshoes 4*f*, 4*f'* are preferably spot welded to the cap 39*f*, which also consists of ferromagnetic material, to provide a closed iron circuit for the magnetic flux when the windings are energised.

The relay in FIGS. 29 to 32 illustrates a novel concept in which the two parts of the coil holder body are two identical contact holder members containing poleshoes 4*g*, 4*g*′, terminals 53*g*, 53*g*′ for the windings, fixed contacts 32*g*, 32*g*′ and a centrally disposed contact terminal 33*g* for a two-bladed contact 31*g*. Magnets 50*g*, 50*g*′ are inserted, and an armature 1*g* which substantially corresponds to the armature 1*c* is mounted between these two identical contact holders 21*g*, 21*g*′. When the two identical contact holders 21*g*, 21*g*′ have been fitted together so that the spring ends 57*g*, 57*g*′ engage, as has already been described in detail with reference to the embodiments illustrated in FIGS. 14, 18, 19 and 20 in the case of contact holder 21*c* and its associated cover 22*c*, two fully operative change-over contacts are automatically created. The armature 1*g* is made of soft iron and has a relatively large cross section. It therefore lacks spring elastic properties and it is mounted in its axis of inertia.

As the magnetic air gap between the ends of the armature and the poleshoes 4*g*, 4*g*′ need not be identical with the spacing of the contacts any tolerance variations in the width of the air gaps between the armature 1*g* and the poleshoes 4*g*, 4*g*′ and the contact spacings are less critical.

Adjustment of the relay is effected at the contact terminal 33*g* or by one of the described methods using corresponding means.

FIGS. 33 to 38 illustrate yet another embodiment of the invention in the case of a polarised relay which has a coil holder body 2*h* consisting of two identical halves in the form of contact holders 21*h*, 21*h*′, and in which pivot bearings 23*h*, 23*h*′ as well as pockets 80, 80′ for the reception of permanent magnets 50*h*, 50*h*′, 50*h*″, 50*h*‴ are formed. These pockets 80, 80′ contain abutments 81, 81′, formed in the mould, for precisely fixing the distances between the permanent magnets 50*h*″, 50*h*‴ as well as the width of the air gap $s_h$ between the poles of the armature 1*h* and the permanent magnets 50*h*, 50*h*′ respectively 50*h*″ and 50*h*‴. The usual tolerances of the permanent magnets 50*h*, 50*h*′ are rendered ineffective by a holding spring 82 which consists of ferromagnetic material, and which serves both as a poleshoe 4*h*, 4*h*′ where it makes contact with the magnets as well as a yoke 5*h* from which the poleshoes are off-angled, also bearing in mind that the position of the poleshoes 4*h*, 4*h*′ has relatively little effect on the functioning of the relay.

Moulded into the contact holder 21*h* which forms one half of the coil holder body are four, preferably round, locating pins 13*h*, 13*h*′, 13*h*″, 13*h*‴ and a similar number of holes 83 in mirror symmetrical disposition thereto. FIG. 37 illustrates the detail H of FIG. 36. In other words, when the two identical contact holders 21*h* are fitted together with their ends reversed, the locating pins 13*h* will also register with corresponding holes 83. A similar arrangement holds in the case of the locating studs 24*g* and the cooperating recesses 75*g* in the preceding embodiment, but a connection by locating pins 13*h* and holes 83 is better suited for achieving a tight frictional fit.

Again in a manner corresponding to the preceding embodiments the terminal pin 33*h* of contact holder 21*h* is connected in the middle by spot welds or brazing to a spring blade 31*h*. As illustrated in FIG. 37 the spring blade 31*h* has a central offset so arranged that the sides which slope towards the offset at an angle $\gamma$ have a self-centering effect in assembly on the spring in relation to the contact terminal pin 33*h*. Preferably the spring blade 31*h* is attached to that side of the contact terminal pin 33*h* which faces the armature 1*h*, and its spring portions are so angled that, when the armature 1*h* is inserted into the bearing sockets 23*h*, 23*h*′, they will bear with pressure against the actuating bosses 14*h*, 14*h*′. This improves the reliability of contact making because of the horizontal fixation thus obtained and because of the bias of the spring blade 31*h* which bears on the contact terminal pin 33*h* with the combined thrust generated by its two biased spring members, so that satisfactory functioning of the relay would be assured even if there were no fixed connection between the two contact elements 31*h* and 33*h*.

In order to take up unwanted tolerances a bearing bush 79 may be fitted over each pivot pin 12*h*, 12*h*′ which are both integrally moulded with the partial sheath 11*h*. This detail is shown in FIG. 34 and again illustrated on a larger scale in FIG. 38. The bearing bush 79, 79′ provides the necessary bearing clearance even if the two half shells forming the sockets 23*h*, 23*h*′ press on the bush 79.

The use of bearing bushes 79 is also on advantage whe integrally moulded pivot pins 12*h*, 12*h*′ are replaced by a pivotal pin 12*f* (FIG. 25) which transverse the armature 1*h*. The pivot pin 12*f* will then have slight clearance inside the walls 98, 98′ of the sockets 23*h*, 23*h*′ and the bearing bush 79, 79′ will have slight clearance in relation to the walls 98, 98′ and to the armature 1*h* so that it can also perform the function of a bearing shoulder.

The relay illustrated in FIG. 33 to FIG. 38 is assembled as follows:

a. Affix the spring blades 31*h* to the contact terminal pin 33*h* embedded in the contact holder member 21*h*.

b. Insert the permanent magnets 50*h*, 50*h*′ into the pockets in the contact holder member 21*h*.

c. Insert the armature 1*h* into the bearing sockets 23*h*, 23*h*′.

d. Fit together two identical contact holder elements 21*h* which have both been pre-assembled as stated in (a) and (b). This automatically biases the spring contact blades.

e. Insert the holding spring 82 until its off-angled ends 84, 84′ snap into engagement with premoulded shoulders 85 (FIG. 33) in the assembled coil holder body 2*h*.

f. Wind the coils 52*h*, 52*h*′ and connect their ends to the winding terminals 53*h*, 53*h*′.

g. Adjust the operate and release thresholds at the ends of the contact terminal 33*h* which are accessible through openings in the centre flange 8*h*.

h. Cover the recesses 25 in the central coil holder flange with a retaining spring 82′ which in the illustrated embodiments is identical with the retaining spring 82 serving as yoke, poleshoe and magnet locating means.

e. As a magnetic shield and for reducing the magnetic stray flux a cap 39*h* of ferromagnetic material may be fitted over the relay.

Intermediately between assembly operations (b) and (d) the faces of the contact holder 21*h* which later abut may be provided with an adhesive, for instance by the so-called screen printing technique and the retaining springs 82, 82′ may be coated if the contact-containing chamber 54*h* is to be airtight and sealed from the environment. Similarly, after assembly operation (i) the relay may be cast in resin to prevent moisture from entering the coil and to improve the mechanical protection of the relay.

In the preceding embodiments (cf. for instance FIGS. 2, 3, 4, 16) of the invention, it has been explained that the contact holder 21, 21*c* is formed with moulded recesses 25, 25*c* for the space-saving accommodation of components 7, 7′, 7*h*. In the embodiment illustrated in FIGS. 33, 34, 35 a wider employment of such components is rendered possible by the addition of a conductor plate 86 for their reception. In such a case the upper ends of the coil terminals 53*h*, 53*h′* are electrically connected to the circuit on the conductor plate 86 and at least one of the ends of a coil terminal 53*h* projecting from the relay is isolated to prevent an undesirably high potential from entering the conductor plate circuit 88. On the other hand the conductor plate circuit 88 will usually require one or two additional terminals. For this purpose, the contact holder, as described with reference to FIG. 16, contains at least one locating hole 90 which permits an additional terminal pin to be fitted. The invention can then be further developed by providing the contact holder 21*h* with lateral sloping faces 91 for mounting a potentiometer 87. If this potentiometer is connected in series with the coil 52, it can be used to adjust the operate and/or release thresholds exactly. The oblique affixation of the potentiometer 87 to the relay has the advantage that it is accessible for adjustment in any position of the relay, even when this is contained in a pocket in a control system. Accordingly, a cap for such an arrangement must be provided with a window 93 in a sloping face 92 of the cap which is substantially parallel to the sloping mounting face 91 of the contact holder 21*h*. However, if the cap is to be universally applicable, it is advisable to provide a window 94 in the edge of the cap facing the potentiometer.

As demonstrated by the description of only seven embodiments, the present invention opens up fresh paths of development in the technology of relay design. It has been repeatedly emphasized that special features of one embodiment can be nearly always applied with the same advantages to other embodiments, so that combinations of the several features described in different contexts of the above specification should also be considered as being within the scope of the present invention.

While specific embodiments of the invention have been shown and described in detail to illustrate the application of the inventive principles, it will be understood that the invention may be embodied otherwise without departing from such principles.

What is claimed is:

1. In an electromagnetic relay structure having an armature, coil means, contact means including contact terminals and fixed contacts and a coil holder body having said armature located therein, said coil holder body being composed of two substantially exactly interfitting and interconnected parts, the improvement wherein one part only of said two parts of said coil holder body is formed as a contact holder having firmly embedded therein said fixed contacts and said contact terminals, with said contact terminals projecting therefrom to the exterior thereof, and wherein said other of said two parts is formed as a cover member to at least partly define a contact containing chamber.

2. An electromagnetic relay according to claim 1, including armature pivots and bearings for said pivots wherein said bearings for said armature pivots are moulded into said contact holder and into said cover member.

3. An electromagnetic relay according to claim 2 including sheathing formed from insulating material wherein said armature located within said coil holder body is partly sheathed with said insulating material and wherein said armature pivots are configured in the form of pins or sockets moulded into said sheathing.

4. An electromagnetic relay according to claim 3 including spring contact blades and guide pins and bosses for operating spring contact blades, wherein said sheathing is integrally formed with either or both said guide pins and bosses.

5. An electromagnetic relay according to claim 4, wherein said spring contact blades are arranged to generate contact pressures by a suitable biasing thrust thereof, said contact pressures being counteracted by said guide pins when the relay is energised, said relay including actuating bosses for counteracting said contact pressures when the relay is not energised.

6. An electromagnetic relay according to claim 1 including locating studs moulded into one part of said coil holder body with corresponding recesses being provided in the other part thereof, wherein said locating studs include free ends which are split by a slit formed therein and which separates a sprung end from a stiffer end on said locating stud.

7. An electromagnetic relay according to claim 6 wherein said sprung end of said locating stud includes an extension having a bevel edge which is adapted to resiliently snap into a cooperating recess.

8. An electromagnetic relay according to claim 6, wherein said locating studs are formed with tapering ends.

9. An electromagnetic relay according to claim 6, wherein said sprung end of said locating stud is longitudinally formed with sloping sides slightly set back from the adjacent walls of said cooperating recess.

10. An electromagnetic relay according to claim 1, including poleshoes and corresponding recesses extending between said contact holder and said cover member into which said poleshoes are firmly fitted.

11. An electromagnetic relay according to claim 10, including an armature restoring spring attached to at least one of said poleshoes.

12. An electromagnetic relay according to claim 1, wherein at least one partition member is integrally moulded into one part of said coil holder body.

13. An electromagnetic relay according to claim 1 wherein said fixed contacts, said coil and contact terminals are of like shape and so contrived that their external ends are pitched in accordance with a "standard fives pitch (2 T)", whereas on the inside facing of said cover member they are disposed in a bank in a "2.5 pitch (T)".

14. An electromagnetic relay according to claim 1, wherein at least one part of said coil holder contains recesses for the reception therein of electrical components.

15. An electromagnetic relay according to claim 1, wherein at least one part of said coil holder is formed with at least one slot for the reception therein of the ends of wires of the winding of said coil.

16. An electromagnetic relay according to claim 1, wherein said coil holder body is formed to include two end flanges for the reception therein of said coil and with a further flange centrally located for carrying at least one contact terminal.

17. An electromagnetic relay according to claim 16, wherein said third flange is formed to extend on both said contact holder and on said cover member and to contain split threads formed in two halves which in combination form an internal screw thread adapted for engagement with adjusting screws.

18. An electromagnetic relay according to claim 17, wherein said two halves of said screw thread are relatively slightly offset to provide a firm friction fit for said adjusting screws.

19. An electromagnetic relay according to claim 18 wherein said armature consists of a permanent magnet and two poleshoes and wherein a partial sheath with which said pivot pins of said armature are integrally moulded holds together said magnet and said poleshoes.

20. An electromagnetic relay according to claim 19 including angle pieces formed on said partial sheath partly embracing said spring contact blades without mechanical contact to form counter-abutments for said adjusting leaf spring.

21. An electromagnetic relay according to claim 20, wherein a contact terminal is embedded at approximately the center axis of said contact holder and wherein a spring contact blade is affixed to the inner end of said terminal.

22. An electromagnetic relay according to claim 21, wherein said contact terminal is situated in the center between, and in the same plane as, two fixed contacts and wherein pressure applied by contacts at the ends of said spring contact blade to the fixed contacts disregarding the spring rate as such, is determined exclusively by the thickness of the spring contact blade and of the contact terminal as well as the height of the contact.

23. An electromagnetic relay according to claim 1 wherein said coil holder body is formed in a mold to include contact holder recesses, bearing sockets, holes, and fixed contacts, each of which are in relatively fixed positions determined by the configuration of said mould.

24. An electromagnetic relay according to claim 1 including actuating bosses for said armature, with sloping faces being formed on either or both of said armature and actuating bosses to facilitate assembly.

25. An electromagnetic relay according to claim 4 including V-shaped ribs moulded into said contact holder for positioning said spring contact blades in order to aid assembly of the relay.

26. An electromagnetic relay according to claim 1 wherein said contact holder is formed with notches to facilitate the introduction therein of said fixed contacts and contact terminals during production of said relay, and which simultaneously lengthen creep current paths of said relay.

27. An electromagnetic relay according to claim 1 including a cap formed of ferromagnetic material and poleshoes or counter-poleshoes so constructed and positioned that they each form two abutment faces for said cap.

28. An electromagnetic relay according to claim 27 wherein said contact holder is formed with ribs which locate a permanent magnet in one vertical direction and two poleshoes in one horizontal direction.

29. An electromagnetic relay according to claim 28, wherein said cover member is also formed with a rib which locates a permanent magnet in one vertical direction and two poleshoes in one horizontal direction.

30. An electromagnetic relay according to claim 29, wherein four permanent magnets of substantially the same dimensions but different characteristics are used.

31. An electromagnetic relay according to claim 30, including at least one AlNiCo permanent magnet and at least two permanent magnets of barium ferrite having different temperature coefficients used for compensating the effect of ambient temperature upon the resistance of the relay coil and hence upon the operate or release thresholds of the relay.

32. An electromagnetic relay according to claim 16, including an adjusting spring attached to said further coil flange of on said contact holder.

33. An electromagnetic relay according to claim 32, wherein locating pins are formed on said further central flange for said coil to locate an off-angled end of said adjusting spring and for securing the same, said off-angled end of the adjusting spring being urged against said contact holder by a boss integrally molded with said cover member.

34. An electromagnetic relay according to claim 33, wherein said further flange for said coil is moulded with an opening which permits a tool to be inserted for adjusting said adjusting spring.

35. An electromagnetic relay according to claim 34, wherein adjustment is effected by radial bending at the root of a twin-bladed adjusting spring.

36. An electromagnetic relay according to claim 35, wherein the spring thrust of said twin-bladed adjusting spring acts optionally on the one or the other part of a centrally secured contact spring.

37. An electromagnetic relay according to claim 36, wherein the spring thrust generated by at least one said adjusting spring affects the effort needed for resetting said armature only until an actuating boss on said armature makes contact with a spring contact blade and wherein the residual thrust of said adjusting spring adds to the contact pressure generated by the bias of the spring contact blade which remains when the actuating boss ceases to be in contact with the spring contact blade.

38. An electromagnetic relay according to claim 1 wherein said contact holder is formed with a locating pin located with the standard pitch pattern for conductor plates.

39. An electromagnetic relay according to claim 38, wherein said locating pin is connected to said contact holder by a relatively thin wall which breaks off the contact holder when the locating pin is detached, so that a locating hole moulded into said contact holder becomes available for fitting a supplementary terminal pin.

40. An electromagnetic relay according to claim 3, including a bearing bush upon which is mounted each of said pivot pins integrally formed with said partial sheath of the armature.

41. An electromagnetic relay according to claim 40, wherein a pivot pin traversing the armature is mounted in bearing bushes which simultaneously serve as bearing shoulders between the armature and the walls of the bearings.

42. An electromagnetic relay according to claim 2, wherein a pivot pin for mounting said armature is formed in the middle of the contact holder moulding.

43. An electromagnetic relay according to claim 42, including a bearing shoulder formed in said contact holder at the root of said pivot pin and another bearing shoulder for vertically locating the armature formed in the middle of a cover fitted to the contact holder.

44. An electromagnetic relay according to claim 8, including poleshoes consisting of ferromagnetic material welded to a relay cap of said relay.

45. In an electromagnetic relay having a coil holder body and an armature mounted inside said body, said coil holder being composed of two substantially tightly interfitting parts, the improvement wherein said two parts of said coil holder body essentially consist of two identically constructed contact holders.

46. An electromagnetic relay according to claim 45 wherein said contact holders contain split bearing sockets for said armature.

47. In an electromagnetic relay having a coil holder body and an armature mounted inside said body, said coil holder being composed of two substantially tightly interfitting parts, the improvement wherein said two parts of said coil holder body essentially consist of two identically constructed contact holders and wherein one half of a further coil flange is formed in the middle of said contact holders and contains a contact terminal pin to which a twin-bladed contact blade is centrally fixed attached.

48. An electromagnetic relay according to claim 47, wherein said twin-bladed contact spring is centrally off-angled in such a way that the resultant angle of inclination causes it to align with a contact terminal pin of said relay during assembly thereof.

49. An electromagnetic relay according to claim 48, wherein two spring blades of each of said two twin-bladed contact springs bear with tensile bias against actuating bosses so that in the assembled state the bias of said two contact springs acting on the setting force of said armature on mirror symmetrically opposite sides of perpendicular axes thereof are substantially compensated.

50. An electromagnetic relay according to claim 49, wherein adjustment of the relay for establishing a stable state of the armature on one or both sides, as well as the adjustment of the operate or release thresholds of response is effected by radially bending the end of a contact terminal which is accessible in the interior of the relay through an opening in the further central coil flange.

51. In an electromagnetic relay, having a coil holder body and an armature mounted inside side body, said coil holder being composed of two substantially tightly interfitting parts, the improvement wherein said two parts of said coil holder body essentially consist of two identically constructed contact holders and including a retaining spring and a central flange on said coiil holder, wherein recesses in said central flange are covered by said retaining spring.

52. An electromagnetic relay according to claim 51, wherein said retaining spring is of the same shape as said U-shaped retaining spring which forms said poleshoes and wherein said shoulder formed in the middle of said contact holder for fixing the retaining spring substantially corresponds to a shoulder which serves for fixing the other retaining spring.

53. An electromagnetic relay according to claim 52, including a cap of ferromagnetic material for magnetically shielding and for reducing magnetic stray flux arranged to cover the relay so that parts of its side walls bear as closely as possible against the shanks of said U-shaped retaining spring forming said poleshoes.

54. An electromagnetic relay according to claim 53, including cavities between said relay and said cap, said cavities being filled with a castable resin.

55. An electromagnetic relay according to claiim 54, including coil terminals having upper ends mechanically connected to a conductor plate and electrically to a circuit on the plate.

56. An electromagnetic relay according to claim 55, including at least one additional terminal pin electrically connected to the circuit on the conductor plate.

57. An electromagnetic relay according to claim 56, including a potentiometer mounted obliquely either on a sloping face of the contact holder or on a conductor plate in the interior of the relay in such manner that the potentiometer is adjustable vertically as well as horizontally.

58. An electromagnetic relay according to claim 57, wherein the relay is covered by a cap which either has a sloping face containing a window at one upper edge or an opening in the region of the upper edge facing a screw for adjusting the potentiometer.

59. In an electromagnetic relay, having a coil holder body and an armature mounted inside side body, said coil holder being composed of two substantially tightly interfitting parts, the improvement wherein said two parts of said coil holder body essentially consist of two identically constructed contact holders and a U-shaped retaining spring being provided in said contact holders and permanent magnets being provided in said holders, said spring having two shanks forming poleshoes which touch the outer faces of said permanent magnets and also including at least one short circuiting ring provided on at least one of said poleshoes.

60. An electromagnetic relay according to claim 59, including recesses in the body of said coil holder for accommodating components suitable for smoothing an a.c. current used for energizing the relay, or for reducing the exciting current.

61. In an electromagnetic relay including a coil holder body and an armature located therein, said coil holder being of undivided integral construction, the improvement comprising that portions adapted to serve as contact holders and containing therein fixed contacts as well as contact and winding terminals are moulded to flanges of said integral coil holder and wherein an opening which serves as a socket for a pivot pin is formed in the middle of said coil holder and wherein facing the same inside said coil holder there is a pivot pin bearing which forms a bearing shoulder with a funnel-shaped entry opening.

62. An electromagnetic relay according to claim 61, wherein a pivot pin traverses the middle of the relay armature and wherein this pivot pin has a bearing shoulder which in conjunction with the bearing shoulder formed in the interior of the coil holder locates the relay armature in the vertical direction with a suitable amount of clearance.

63. An electromagnetic relay according to claim 61, wherein at least one locating slot is formed in the interior of said coil holder for the reception of a locating web from which two spring contact blades branch to the sides.

64. An electromagnetic relay according to claim 63, wherein said locating web carrying the contact spring blades is electrically and mechanically fixed connected to a contact terminal.

65. An electromagnetic relay according to claim 64, including a spring member which functions as an armature restoring spring extending from an angled flank provided with a fluting in a direction opposed to that of the contact spring blade and wherein the free end of said spring member bears with biasing pressure against an electrically insulating partial sheath surrounding the armature, causing contact to be established by the thrust of an actuating boss on the partial sheath of the armature when the relay is not energised.

66. An electromagnetic relay including a coil holder body and an armature located therein, said coil holder being of undivided integral construction, the improvement wherein portions adapted to serve as contact holders and containing therein fixed contacts as well as contact and winding terminals are molded to flanges of said integral coil holder and including a T-shaped ferromagnetic armature provided on its Tee-arms with a knife edge and armature wings, said knife edge being urged by a U-shaped armature retaining spring having free ends engaging corners in the base of a U-shaped yoke into V-shaped notch punched centrally into the base of said yoke including two adjusting springs, each having one side attached to the base of said yoke with the other sides of said springs being so flexed by adjusting screws that the armature wings underneath are optionally subjected to the different spring thrusts needed to hold the armature in a stable position on one or both sides so that desired operated and/or release response thresholds may be obtained.

67. In an electromagnetic relay including a coil holder body and an armature located therein, said coil holder being of undivided integral construction, the improvement comprising that portions adapted to serve as contact holders and containing therein fixed contacts as well as contact and winding terminals are moulded to flanges of said integral coil holder and wherein fixed contacts in the contact holder part of said coil holder are arranged to function as poleshoes, said fixed contacts being correspondingly made of ferromagnetic material and arranged to make contact on one side with magnets with the other side thereof facing an armature contact being provided with a plate of contact material which also functions as a magnetic separator.

68. An electromagnetic relay according to claim 67, wherein said fixed contacts have faces sloping towards the centre axis of said relay so that the faces of contact plates on said armature will be coplanar with the faces of the contact plates when contact is made.

69. An electromagnetic relay according to claim 68, including magnets having a trapeze-shaped cross section so that one side will bear flush against the sloping fixed contacts forming poleshoes and the other side will bear flush against the faces of the shanks of the U-shaped yoke which extend substantially parallel to the centre line of the relay.

70. In an electromagnetic relay structure having an armature, coil means, contact means including contact terminals and fixed contacts and a coil holder body having said armature located therein, said coil holder body being composed of two substantially exactly interfitting and interconnected parts, the improvement being wherein one part only of said two parts of said coil holder body is formed as a contact holder having firmly embedded therein said fixed contacts and said contact terminals, with said contact terminals projecting therefrom to the exterior thereof, and wherein said other of said two parts is formed as a cover member to at least partly define a contact containing chamber, said coil holder body being formed to include two end flanges for the reception of said coil and a further centrally located flange for carrying at least one contact terminal, said further flange being formed to extend to both said contact holder and said cover member and to contain split threads formed in two halves which together form an internal screw thread adapted for engagement with an adjusting screw, said two halves of said screw thread being relatively slightly offset to provide a firm friction fit for said adjusting screw, an adjusting leaf spring having a nose thereon cooperating with said contact holder, said contact holder having shoulders mounted thereon to form abutment walls for said nose formed on said adjusting leaf spring and wherein pips are formed in said contact holder to provide a firm abutment on one side of one end of said adjusting leaf spring when said spring is flexed by said adjusting screws.

71. In an electromagnetic relay having a coil holder body and an armature inside said body, said coil holder body being composed ot two substantially tightly interfitting parts, the improvement being wherein said two parts of said coil holder body essentially consist of two identically constructed contact holders, and wherein a U-shaped retaining spring of ferromagnetic material is provided in said two identical contact holder parts, said spring retaining permanent magnets in said holders, said U-shaped spring having two shanks forming pole shoes mechanically contacting outer pole faces of said permanent magnets, another retaining spring having off-angled ends which engage shoulders in said contact holders and a further retaining spring similarly disposed as the symmetrical mirror image on the opposite side of the relay.

72. In an electromagnetic relay including a coil holder body and an armature located therein, said coil holder being of undivided integral construction, the improvement being wherein said coil holder has flanges therein and wherein portions adapted to serve as contact holders and containing therein fixed contacts as well as contact and winding terminals are molded to said flanges of said integral coil holder, and wherein said armature is a T-shaped ferromagnetic element provided on the arms of the "T" with a knife edge and armature wings, and wherein a U-shaped armature retaining spring and a U-shaped yoke is included, said spring having free ends engaging corners in the base of the said U-shaped yoke, said U-shaped yoke having a V-shaped notch positioned centrally in the base of said yoke, said knife being urged by said spring into said V-shaped notch.

* * * * *

UNITED STATES PATENT OFFICE

CERTIFICATE OF CORRECTION

Patent No. 3,946,347 Dated March 23, 1976

Inventor(s) Hans Sauer

It is certified that error appears in the above-identified patent and that said Letters Patent are hereby corrected as shown below:

In the heading of the Patent, [73] should read as follows:

--[73] Assignee: Matsushita Electric Works Ltd., undivided one half--.

Signed and Sealed this

Thirteenth Day of July 1976

[SEAL]

*Attest:*

RUTH C. MASON
*Attesting Officer*

C. MARSHALL DANN
*Commissioner of Patents and Trademarks*